US006669180B2

(12) United States Patent
Ziegler

(10) Patent No.: US 6,669,180 B2
(45) Date of Patent: Dec. 30, 2003

(54) GAS-HYDRAULIC SHOCK ABSORBER ASSEMBLY

(75) Inventor: Otto Ziegler, Thayngen (CH)

(73) Assignee: Schwab Verkehrstechnik AG (CH)

( * ) Notice: Subject to any disclaimer, the term of this patent is extended or adjusted under 35 U.S.C. 154(b) by 0 days.

(21) Appl. No.: 10/216,458

(22) Filed: Aug. 9, 2002

(65) Prior Publication Data

US 2003/0030198 A1 Feb. 13, 2003

(30) Foreign Application Priority Data

Aug. 10, 2001 (CH) ..... 1473/01
May 6, 2002 (CH) ..... 0758/02

(51) Int. Cl.[7] ..... B61G 11/00

(52) U.S. Cl. ..... 267/139; 213/223; 213/43; 188/269; 188/314; 267/64.15; 267/116; 267/115

(58) Field of Search ..... 267/139, 140, 267/116, 113, 64.15, 115, 64.26; 213/223, 43; 188/269, 314, 315, 318, 297, 288; 293/134; 92/8; 91/408, 409

(56) References Cited

U.S. PATENT DOCUMENTS

| | | | | |
|---|---|---|---|---|
| 3,252,587 A | * | 5/1966 | Scales | 213/43 |
| 3,731,771 A | | 5/1973 | Borgo | |
| 4,805,517 A | | 2/1989 | Conley et al. | |
| 5,845,796 A | | 12/1998 | Miller | |
| 2003/0030198 A1 | * | 2/2003 | Ziegler | 267/139 |

FOREIGN PATENT DOCUMENTS

| | | | |
|---|---|---|---|
| EP | 0 133 157 | | 2/1985 |
| EP | 001283142 A1 | * | 2/2003 |
| EP | 001283143 A1 | * | 2/2003 |

* cited by examiner

*Primary Examiner*—Douglas C. Butler
(74) *Attorney, Agent, or Firm*—Maginot, Moore & Beck

(57) ABSTRACT

The gas-hydraulic shock absorber assembly comprises a sleeve member and a ram member movable relative to the sleeve member. In the interior of the ram member, a gas chamber is provided that is pressurized by means of a gas. In the interior of the sleeve member, an oil chamber is provided that is filled with a hydraulic medium and which decreases in volume the more the ram member is moved relative to the sleeve member. Between the two chambers, a gas-hydraulic control assembly is provided. Upstream of the control assembly, there is a bleeding assembly, comprising a transfer channel opening into a portion of the oil chamber remote from the control assembly. Further provided is a bleeding channel, opening into an upper portion of the oil chamber and connecting the transfer channel to the control assembly when the shock absorber assembly is at rest. The bleeding assembly comprises several channels connecting the oil chamber to the control assembly and comprising each a V-shaped valve flap to close the channels. Even if the ram member is moved slowly relative to the sleeve member, any gas collected in the oil chamber can escape through the transfer channel and/or the bleeding channel. At high relative moving velocities, the two legs of the valve flaps are moved towards each other such that the oil can flow through the channels of the bleeding assembly, whereby the collected gas can escape through the transfer channel and the bleeding channel.

13 Claims, 2 Drawing Sheets

GAS-HYDRAULIC SHOCK ABSORBER ASSEMBLY

BACKGROUND OF THE INVENTION

The present invention relates to a gas-hydraulic shock absorber assembly, particularly for push and/or pull devices of rail vehicles. It comprises a sleeve member, a ram member movable relative to the sleeve member, a gas chamber located in the sleeve member or in the ram member and adapted to be pressurized by means of a gaseous medium, and an oil chamber located in the ram member or in the sleeve member and containing a hydraulic medium.

Gas-hydraulic shock absorber assemblies to be used in push devices or pull devices of rail vehicles are well known in the prior art, for instance in the form of so-called bumpers. However, a shock absorber assembly designed according to the invention can also be used for example in couplings of rail vehicles, particularly couplings adapted to interconnect a plurality of rail vehicles.

In known gas-hydraulic shock absorber assemblies having no physical separation means to separate the gaseous and fluid media, the fundamental danger is present that gaseous medium collects in the fluid chamber after a certain period of use; of course, this is highly undesirable because it can impair the proper function of the shock absorber assembly, even lead to malfunction thereof. For example, too much gaseous medium in the fluid chamber can lead to an undefined or insufficient resilient behavior e.g. of a rail vehicle bumper. Particularly, if such a bumper is hit very hard, there is a high danger that gaseous medium enters the fluid chamber.

OBJECTS OF THE INVENTION

Thus, it is an object of the invention to provide a gas-hydraulic shock absorber assembly of the kind mentioned herein before which bleeds itself during its operation by automatically recycle any gaseous medium that may have collected in the fluid chamber to the gas chamber.

SUMMARY OF THE INVENTION

In order to meet this and other objects, the present invention provides a gas-hydraulic shock absorber assembly, particularly for push and/or pull devices of rail vehicles. It comprises a sleeve member, a ram member movable relative to the sleeve member, a gas chamber located in the sleeve member or in the ram member and adapted to be pressurized by means of a gaseous medium, and an oil chamber located in the ram member or in the sleeve member and containing a hydraulic medium.

Further, the shock absorber assembly comprises a gas-hydraulic control assembly arranged between the gas chamber and the oil chamber, and a bleeding assembly, incorporating a transfer channel opening into an upper portion of the oil chamber and providing a communication between the oil chamber and the gas chamber.

BRIEF DESCRIPTION OF THE DRAWINGS

In the following, an embodiment of the shock absorber assembly according to the invention will be further described, with reference to the accompanying drawings, in which.

DETAILED DESCRIPTION OF A PREFERRED EMBODIMENT

Figure 1:
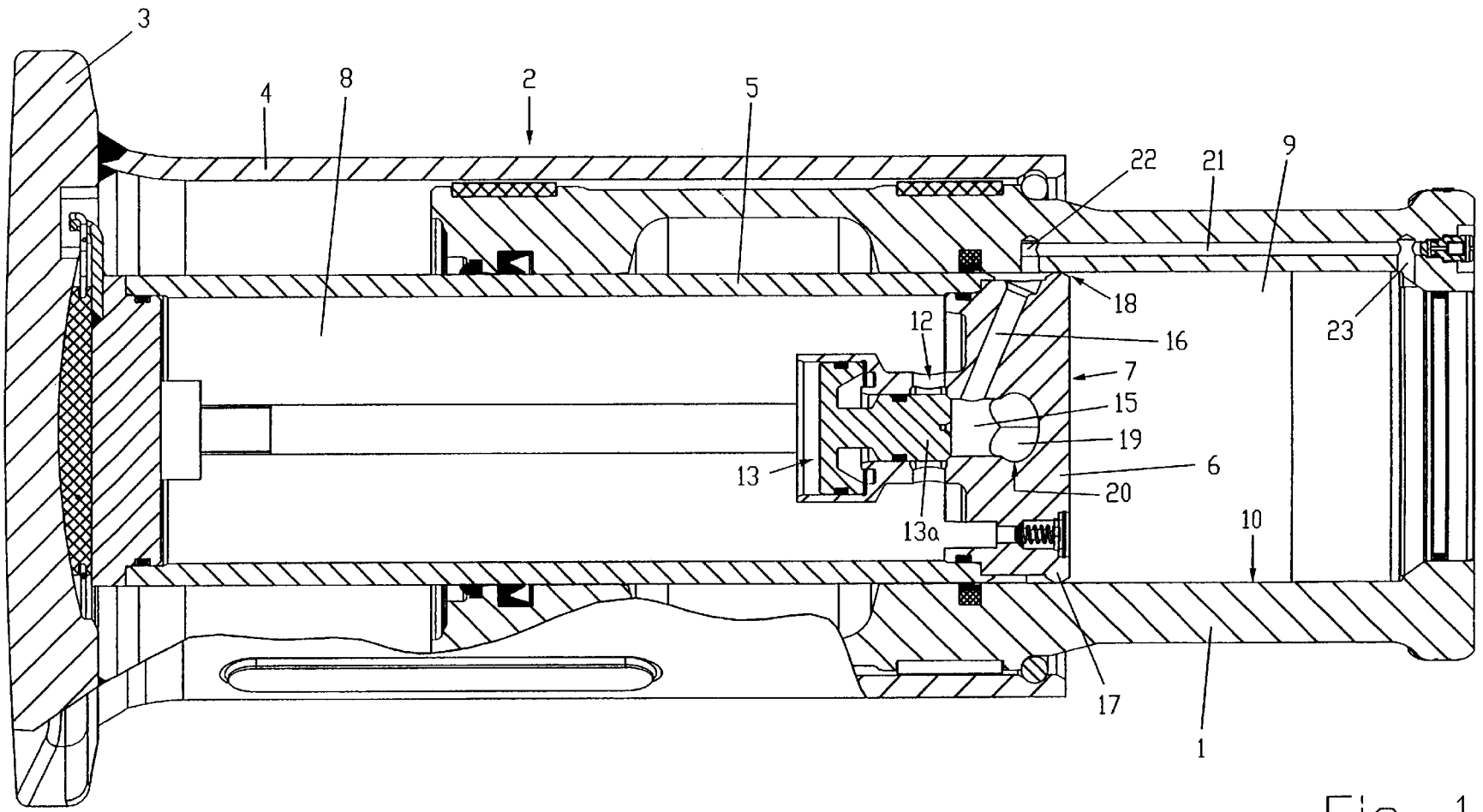
FIG. 1 shows a longitudinal sectional view of the gas-hydraulic shock absorber assembly in the form of a bumper.

The general design of an assembly according to the invention will now be further explained with the help of FIG. 1, showing a longitudinal sectional view of a gas-hydraulic shock absorber assembly in the form of a bumper incorporating a bleeding assembly designed in accordance with the invention. It is to be noted that the bumper is shown in FIG. 1 in its released state, i.e. no load force acting on it.

The bumper comprises a bumper sleeve 1 to be connected to a rail vehicle (not shown), as well as a bumper ram member 2 including an outer ram member tube 4, an inner plunger tube 5 and a bumper head member 3. Both the ram member tube 4 and the plunger tube 5 are operationally connected to the bumper head member 3. The end of the plunger tube 5 facing the rail vehicle is provided with a flange member 6. The interior of the plunger tube 5 constitutes a gas chamber 8 adapted to contain a gaseous medium pressurized to 5–20 bar as well as a portion of a hydraulic medium.

In the interior of the bumper sleeve 1, an oil chamber 9 is constituted. In the released state of the bumper, as shown in FIG. 1, the gas chamber 8 is partially filled with a hydraulic medium, while the oil chamber 9 is entirely filled with the hydraulic medium. The flange member 6 constitutes, together with a valve assembly 13, a gas-hydraulic control device 12, controlling the flow rate of the hydraulic medium from the oil chamber 9 into the gas chamber 8 in relation to the load force applied to the bumper head 3 during the compression of the bumper.

The valve body member 13*a* of the valve assembly 13 is biased in the direction towards the oil chamber 9, due to the overpressure present in the gas chamber 8. The flange 6 comprises an annular projection 17 located at its right side, i.e. facing the oil chamber 9. This annular projection 17 operates, together with channels, recesses, bores, valves and a transfer channel 21, as a bleeding assembly 7. The transfer channel 21, located outside the oil chamber 9 in the wall of the bumper sleeve 1, is provided at both of its ends with a bore 22, 23 radially opening into the oil chamber 9. One of the bores, i.e. the bore 22, radially opens into the upper portion of the oil chamber 9 at the side thereof facing the control device 12, while the other bore 23 radially opens into the upper portion of the oil chamber 9 at the side thereof remote from the control device 12. The assembly being in its rest or released position, as shown in FIG. 1, the transfer channel 21 is connected to the control device 12 at its side facing the control device 12 via a bleeding channel 16. Thus, it is ensured that any gas that may have collected in the rear upper portion of the oil chamber 9 can escape from the rear upper portion of the oil chamber 9 through the transfer channel 21 upon subjecting the bumper to a load. The design and the operation of the of the bleeding assembly 7 will be further explained herein below.

The flange 6 is provided with a central recess, located adjacent to the valve assembly 13, to form a chamber 15. From this chamber 15, a bleeding channel 16 runs radially inclined upwards to the left side of the annular projection 17, where it opens into the oil chamber 9. Between the annular projection 17 of the flange 6 and the wall 10 of the oil chamber 9, there is an annular gap 18. Upon subjecting the bumper to a load force, thereby causing the bumper head 3 and its associated elements to move to the right, as seen in FIG. 1, oil and, if appropriate, gas that may have collected in the upper portion of the oil chamber 9 flow through the annular gap 18 to the left side of the annular projection 17. Therefrom, it can flow via the bleeding channel 16 into the chamber 15 and via the valve body member 13*a*, being released under the influence of the now existing overpressure, into the gas chamber 8. As already mentioned, the upper portion of the oil chamber 9, remote from the control device 12, communicates via the transfer channel 21 and the bleeding channel 16 with the control device 12, with the result that any gas collected in the rear portion of the oil chamber 9 can flow via the rear radial bore 23 into the real transfer channel 21 and, therefrom, via the front radial bore 22 into the bleeding channel 16. Finally, the gas can flow from the bleeding channel 16 through the open valve assembly back into the gas chamber 8. As the bumper ram member 2 is further moved to the right, one end of the transfer channel 21 is closed because the inner plunger tube 5 is moved into a position in front of the front radial bore 22 of the transfer channel 21.

A further channel 20, directly connecting the oil chamber 9 to the chamber 15, is only partially shown in FIG. 1. In the interior of this channel 20, a valve flap 19 is provided which closes the channel 20 once the bumper is in its rest position. In all, four of such channels 20 are provided, each having an associated valve flap 19; further explanation referring thereto will be given herein after with regard to FIG. 2.

Figure 2:
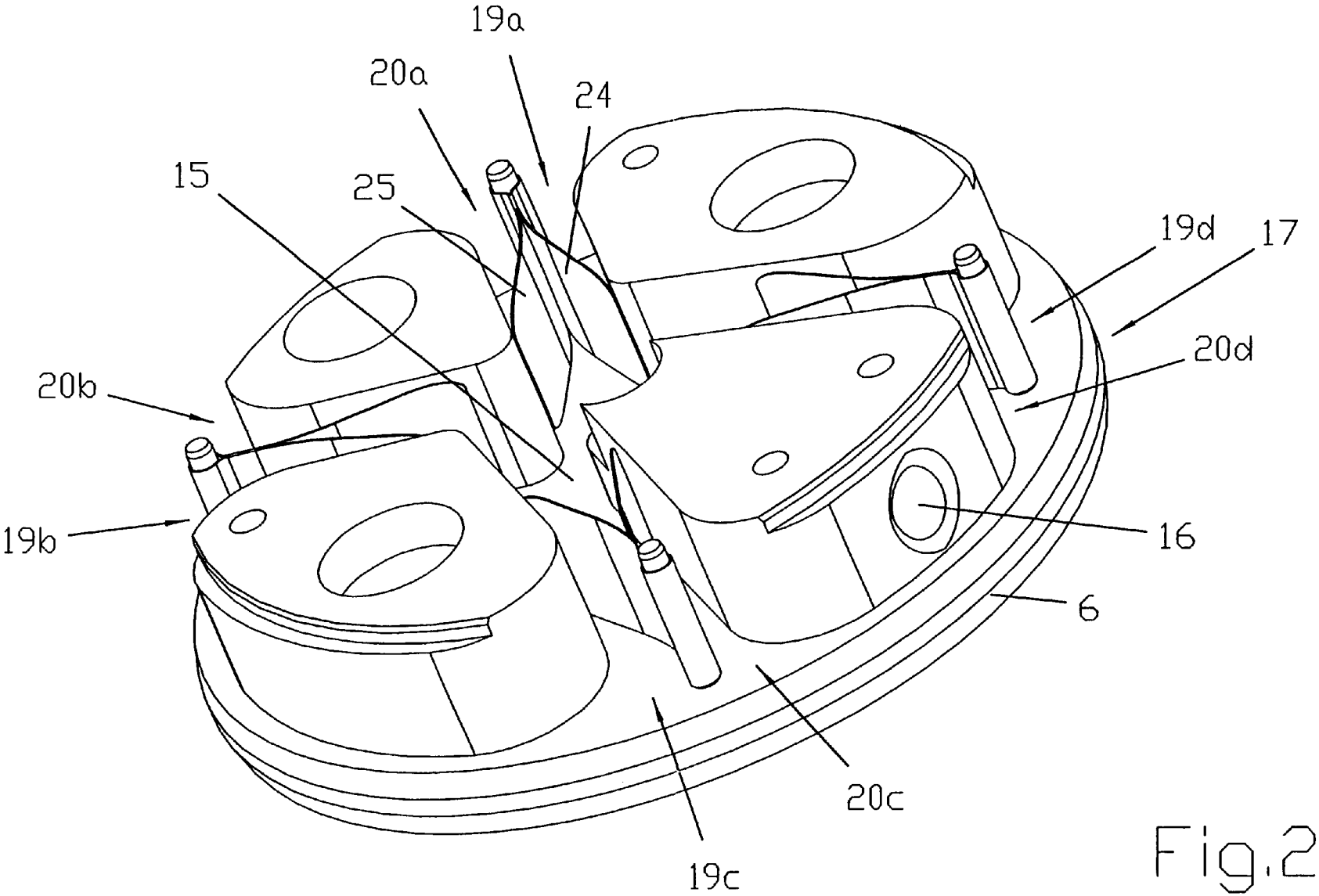
FIG. 2 shows a perspective view of a bleeding assembly.

In FIG. 2, the bleeding assembly 7 is shown in a perspective view. Clearly visible in FIG. 2 are the four channels 20*a*, 20*b*, 20*c* and 20*d*, provided in the flange member 6, and incorporating each a V-shaped valve flap 19*a*, 19*b*, 19*c* and 19*d*. Each of these valve flaps 19*a*, 19*b*, 19*c* and 19*d* comprises two legs, whereby in the following reference is made, for simplicity's sake, only to the legs 24, 25 of the valve flap 19*a*. The two legs 24, 25 of the valve flaps 19*a*–*d* resiliently rest against the walls of the channels 20*a*–20*d*, if the bumper is in its rest position, as shown in FIGS. 1 and 2. Thereby, each of the valve flaps 19*a*–19*d* seal the associated channel 20*a*–20*d*. Under the influence of the overpressure generated in the oil chamber 9, caused by a quick compression of the bumper and urging the bumper ram member 2 to move to the right, the two legs 24, 25 are resiliently bent towards each other, with the result that a passage is created in the associated channel 20 through which the oil repressed from the oil chamber 9 can flow into the central chamber 15.

The bleeding channel 16, running essentially radially through the flange member 6, is also shown in FIG. 2. The inner diameter of the oil chamber 9 decreases towards the right side, i.e. towards the vehicle, with the result that the annular gap 18 between the annular projection 17 and the wall of the oil chamber 9 gradually decreases when the bumper ram member 2 is moved to the right side.

The operation of the bleeding assembly may be explained as follows:

Upon subjecting the bumper to a load, the outer ram member tube 4 as well as the inner plunger tube 5 and the flange 6 is moved to the right, as seen in FIG. 1. Thereby, oil and, if appropriate, gas that may have collected in the upper portion of the oil chamber 9 flow from the oil chamber 9 through the annular gap 18 to the left side of the annular projection 17 of the flange member 6. Due to the overpressure existing in the oil chamber 9, the gas is repressed into the chamber 15 via the bleeding channel 16 opening into the upper portion of the oil chamber 9; therefrom, it flows through the valve assembly 13 into the gas chamber 8. Since the four channels 20*a*, 20*b*, 20*c* and 20*d* provided in the flange member 6 are closed each by one of the valve flaps 19*a*, 19*b*, 19*c* and 19*d*, respectively, when the bumper is in its rest position, a ram pressure is generated upon moving the bumper ram member 2 and the plunger tube 5 including the flange member 6 to the right; the result is that the gas to be repressed from the oil chamber 9 compellingly escapes through the bleeding channel 16, even if the movement to the right of the above mentioned elements is slow.

Due to the difference of the specific gravity of gas and oil and due to the fact that high acceleration values occur if the bumper is hit by another rail vehicle, the gas is collected in the upper rear portion of the oil chamber 9 upon a hit. The quick movement of the bumper ram member 2 to the right also causes a high pressure differential between oil chamber 9 and the left side of the annular projection 17. This pressure differential initiates a current flowing in the transfer channel 21 which displaces the gas from the rear portion of the oil chamber 9, remote from the flange 6, into the gas chamber 8 within a very short period of time.

During high moving speeds of the bumper ram member 2, a correspondingly high overpressure is generated in the oil chamber 9. That high overpressure causes the two legs 24, 25 of the valve flaps 19*a*–19*d* to resiliently bend towards each other, with the result that the oil can pass the valve flaps 19*a*–19*d* and flow through the channels 20*a*–20*d* without substantial drag. Thus, upon a high moving speed of the bumper ram member 2, the oil can flow from the oil chamber 9 to the chamber 15 through all channels 16, 20*a*, 20*b*, 20*c* and 20*d*. However, upon a low moving speed of the bumper ram member 2, the gas collected in the oil chamber 9 compellingly flows through the bleeding channel 16 into the chamber 15.

The bleeding assembly 7 according to the present invention is of simple design and can be manufactured at low costs. The V-shaped valve flaps 19*a*, 19*b*, 19*c* and 19*d* show the advantage that they incur only a very low drag to the oil flowing through the channels 20 upon high moving speeds of the bumper ram member 2.

What is claimed is:

1. Gas-hydraulic shock absorber assembly, particularly for push and/or pull assemblies of rail vehicles, comprising:

a sleeve means;

a ram means movable relative to said sleeve means;

a gas chamber means located in said sleeve means or in said ram means and adapted to be pressurized by means of a gaseous medium;

an oil chamber means located in said ram means or in said sleeve means and containing a hydraulic medium, said oil chamber means being adapted to decrease its volume upon a relative movement of said sleeve means and said ram means;

a gas-hydraulic control means arranged between said gas chamber and said oil chamber; and a bleeding assembly means, incorporating a transfer channel means opening into an upper portion of said oil chamber means and providing a communication between said oil chamber means and said gas chamber means.

2. Gas-hydraulic shock absorber assembly according to claim 1 in which said bleeding assembly means is operationally located upstream of said gas-hydraulic control means.

3. Gas-hydraulic shock absorber assembly according to claim 2 in which said transfer channel means runs outside said oil chamber means and opens radially into the upper portion of said oil chamber means both at its end remote from said gas-hydraulic control means as well as at its end facing said gas-hydraulic control means, whereby at least one bleeding channel means is provided by means of which said transfer channel means is connected to said gas-hydraulic control means at the end of said transfer channel means facing said gas-hydraulic control means.

4. Gas-hydraulic shock absorber assembly according to claim 3 in which said bleeding assembly means comprises a flange means operationally connected to said ram means and movable in said oil chamber means, said bleeding channel means being located in said flange means.

5. Gas-hydraulic shock absorber assembly according to claim 4 in which said flange means further comprises at least one oil channel means connecting said oil chamber means to said gas-hydraulic control means, said oil channel means or each of said oil channel means being provided with a spring biased valve means adapted to be operated, against the biasing force, by the oil escaping from said oil chamber means.

6. Gas-hydraulic shock absorber assembly according to claim 5 in which said bleeding channel means and said oil channel means open into a common chamber means, whereby a valve assembly means is provided that is located upstream of said chamber means.

7. Gas-hydraulic shock absorber assembly according to claim 4 in which said flange means comprises an annular projection means having an outer diameter smaller than the inner diameter of said oil chamber means, thus creating a gap between said annular projection means and said oil chamber means, whereby said bleeding channel means and said oil channel means lead radially outward from said flange means at the side of said annular projection means that is remote from said oil chamber means.

8. Gas-hydraulic shock absorber assembly according to claim 4 in which said transfer channel means extends within said sleeve means, and in which said ram means is provided with an inner plunger tube means, said flange means movable in said oil chamber means being connected to said inner plunger tube means.

9. Gas-hydraulic shock absorber assembly according to claim 5 in which said oil channel means is provided with a V-shaped valve flap means having two leg means, said leg means resiliently resting on the walls of said oil channel means when said shock absorber assembly is in the rest position, whereby said two leg means are movable, contrary to the biasing force, towards each other to open a passage in said oil channel means under the influence of an increase in pressure in said oil chamber means occurring during subjecting said shock absorber assembly to a load force.

10. Gas-hydraulic shock absorber assembly according to claim 7 in which said oil chamber means has a gradually decreasing diameter in the direction of movement of said ram means, such that said annular gap between said annular projection means and the wall of said oil chamber means gradually decreases upon a movement of said ram means.

11. Gas-hydraulic shock absorber assembly according to claim 1 in which said transfer channel means is adapted to be closed at least at one end thereof upon an increasing movement of said ram means.

12. Gas-hydraulic shock absorber assembly according to claim 5 in which said flange means comprises an annular projection means having an outer diameter smaller than the inner diameter of said oil chamber means, thus creating a gap between said annular projection means and said oil chamber means, whereby said bleeding channel means and said oil channel means lead radially outward from said flange means at the side of said annular projection means that is remote from said oil chamber means.

13. Gas-hydraulic shock absorber assembly according to claim 6 in which said flange means comprises an annular projection means having an outer diameter smaller than the inner diameter of said oil chamber means, thus creating a gap between said annular projection means and said oil chamber means, whereby said bleeding channel means and said oil channel means lead radially outward from said flange means at the side of said annular projection means that is remote from said oil chamber means.

* * * * *